United States Patent [19]

Goodman et al.

[11] Patent Number: 4,529,257

[45] Date of Patent: Jul. 16, 1985

[54] COMBINED ELECTRICAL SHIELD AND ENVIRONMENTAL SEAL FOR ELECTRICAL CONNECTOR

[75] Inventors: David S. Goodman, Mission Viejo; Gerald J. Selvin, Huntington Beach, both of Calif.

[73] Assignee: International-Telephone & Telegraph Corp., New York, N.Y.

[21] Appl. No.: 468,267

[22] Filed: Feb. 22, 1983

[51] Int. Cl.[3] ..... H01R 4/00

[52] U.S. Cl. ..... 339/94 M; 339/143 R

[58] Field of Search ..... 339/94, 60; 174/35 GC, 174/35 C, 84 S; 411/544

[56] References Cited

U.S. PATENT DOCUMENTS

| | | | |
|---|---|---|---|
| 3,126,440 | 3/1964 | Goodloe | 174/35 GC |
| 3,213,187 | 10/1965 | Kish | 174/84 S |
| 3,259,406 | 7/1966 | Kish | 174/84 S |
| 3,304,104 | 2/1967 | Wiltse | 174/84 S |
| 3,505,463 | 4/1970 | McAdams | 174/35 GC |
| 3,739,076 | 6/1973 | Schwartz | 339/94 R |
| 3,835,443 | 9/1974 | Arnold et al. | 339/143 R |
| 4,033,654 | 7/1977 | Ross | 339/143 R |
| 4,138,183 | 2/1979 | Soos | 339/94 M |
| 4,280,390 | 7/1981 | Murray | 411/544 |
| 4,391,483 | 7/1983 | Desourteaux | 339/94 R |

*Primary Examiner*—Gil Weidenfeld
*Assistant Examiner*—David L. Pirlot
*Attorney, Agent, or Firm*—T. L. Peterson

[57] ABSTRACT

A combined EMI/RFI shield and environmental sealing element for an electrical connector in which a helical coil spring is partially embedded in an elastomeric ring having an enlarged sealing portion on at least one side of the spring. The exposed surfaces of the coil spring engage facing peripheral surfaces on the shells of the mating connector halves of the electrical connector.

8 Claims, 16 Drawing Figures

COMBINED ELECTRICAL SHIELD AND ENVIRONMENTAL SEAL FOR ELECTRICAL CONNECTOR

BACKGROUND OF THE INVENTION

The present invention relates generally to an electrical connector and, more particularly, to an arrangement for providing electrical shielding and environmental sealing for the mating halves of an electrical connector.

The use of shielding in electrical connectors to eliminate unwanted radio frequency and electro-magnetic signals (RFI/EMI) from interfering with signals being carried by the contacts in connectors is well known. U.S. Pat. Nos. 3,521,222; 3,678,445; 4,106,839 and 4,239,318 disclose annular shields formed of sheet metal with resilient fingers which electrically engage the outer surface of the plug barrel and the inner surface of the receptacle shell of the electrical connector.

U.S. Pat. No. 3,835,443 discloses an electrical connector shield comprising a helically coiled conductive spring which is interposed between facing annualar surfaces on the mating halves of an electrical connector. The spring is coiled in such a manner that the convolutions thereof are slanted at an oblique angle of the center axis of the connector members. When the connector members are mated, the spring is axially flattened to minimize the gap between the convolutions thereof and to provide a wiping electrical engagement with the annular surfaces on the mating halves of the connector.

U.S. Pat. No. 4,033,654 discloses another form of slant coil spring shield for an electrical connector in which the spring is mounted in an internal groove formed in the receptacle shell. The convolutions of the spring are arranged in such a fashion that they will collapse radially when the plug barrel is slid into the receptacle shell.

Of course, it is well known in the art to utilize various forms of annular rings, such as O-rings, for providing environmental sealing between the mating halves of electrical connectors. However, such seals have been separate from any electrical shield which might be provided in the connector. As a consequence, separate annular grooves have been formed in the connector members in order to receive the electrical shield and the environmental sealing ring, which adds to manufacturing and assembly costs, and increasing the size of the connector assembly. Also, it is possible that the slant coil spring may be damaged during handling upon assembly of the connector or during use of the connector in the field.

It is the object of the present invention to overcome the aforementioned disadvantages of the conventional electrical shielding and sealing arrangement used for electrical connectors.

Of interest in the art of electrical shielding and environmental sealing is a composite EMI shield and environmental sealing gasket comprising a plurality of individual fine wires embedded and bonded in a solid silicone elastomer, with the wires oriented perpendicular to the mating surfaces of the product in which the gasket is installed. The manufacturer states that the wires are convoluted to allow compressing and rebounding like individual springs. Another composite shielding gasket for EMI shielding and environmental sealing utilizes a resilient knitted wire mesh strip which is mated to a silicone rubber strip wherein some of the elastomer is permitted to penetrate the porous boundary face of the wire mesh strip. In each case, the composite shielding and sealing elements are in strip or sheet form, and to our knowledge have not been shaped into closed loops for use in electrical connectors. Furthermore, the prior art gaskets do not embody any means for preventing dirt and other contaminants from reaching the conductors of the gaskets.

SUMMARY OF THE INVENTION

According to a principal aspect of the present invention, there is provided an electrical connector comprising first and second mating connector members having spaced peripheral surfaces thereon facing each other when the connector members are mated defining a space therebetween. A substantially closed loop combined electrical shielding and environmental sealing element is disposed in this space. The element comprises an elastomeric ring having a helical coil spring partially embedded therein. The convolutions of the coil spring are exposed at the edges of the ring on opposite sides thereof adjacent to the peripheral surfaces of the connector members. The elastomeric ring embodies an enlarged sealing portion on at least one side of the coil spring providing oppositely facing sealing ribs each adjacent to a respective peripheral surface. The outside dimensions of the convolutions and of the enlarged sealing portion of the ring in the direction between the peripheral surfaces are greater than the distance between said surfaces whereby the convolutions will deform and the sealing ribs of the ring will be compressed when the connector members are mated.

Thus, by the present invention there is provided a composite electrical shielding and environmental sealing element which is in the form of a ring that may be inexpensively manufactured and easily installed in a single annular or closed loop groove thus eliminating one machining operation and reducing assembly costs. The element may be conveniently manufactured by molding the elastomeric ring around the coil spring whereby the elastomer will provide protection for the spring against damage during assembly and during use of the connector in which it is installed. An important advantage of the invention is that the enlarged sealing portion of the elastomeric ring will prevent contaminants from reaching the exposed convolutions of the coil spring so that an effective electrical contact may be maintained between the coil spring and the connector body even over a long period of time and exposure to adverse environments. Preferably the elastomeric ring is molded as a continuous loop so as to provide a continuous sealing surface around the ring which is not interrupted by a bond line that might create a leakage path across the opposite sides of the ring.

DESCRIPTION OF THE PREFERRED EMBODIMENTS

Figure 1:
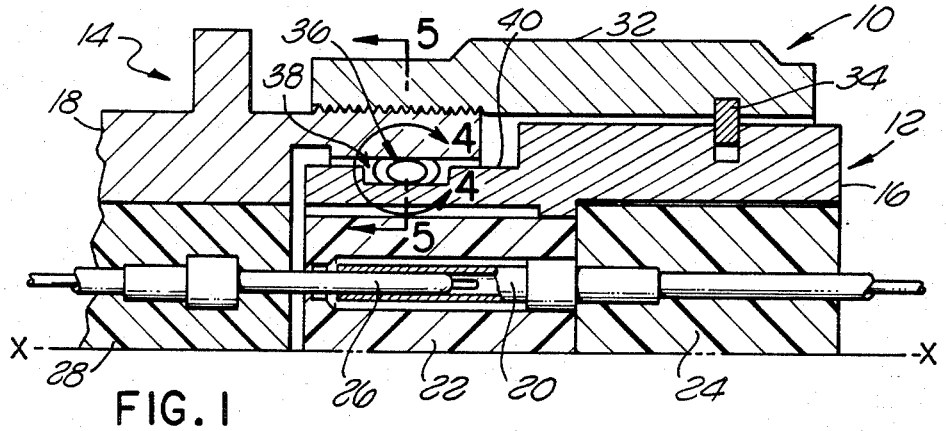
FIG. 1 is a partial longitudinal sectional view through an electrical connector, shown in its fully mated condition, embodying one form of the composite electrical shielding and environmental sealing element of the present invention embodying enlarged sealing portions on opposite sides of a slant coil spring.
Figure 2:
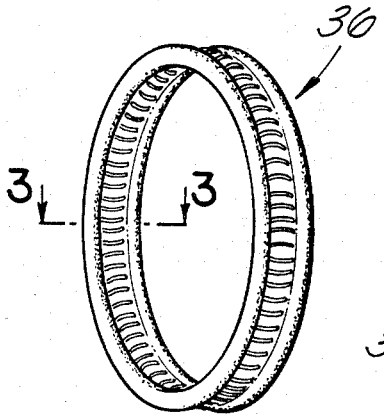
FIG. 2 is a perspective view of the shielding and sealing element illustrated in FIG. 1.
Figure 3:
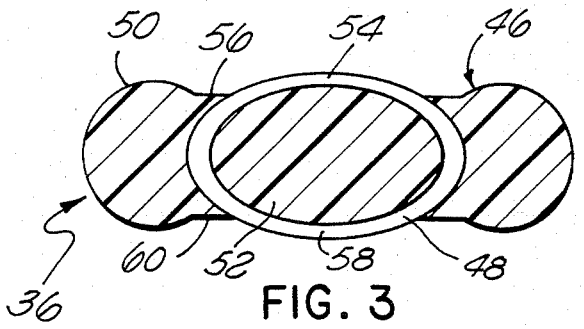
FIG. 3 is an enlarged transverse sectional view taken along line 3—3 of FIG. 2 showing the cross section of the element.

Referring now to the drawings in detail, there is shown in FIG. 1 one embodiment of the connector of the present invention, generally designated 10, comprising a plug connector member 12 and a receptacle connector member 14. The plug connector member comprises a cylindrical barrel 16 which is telescopically positioned in the front end of the cylindrical shell 18 of the receptacle connector member. A plurality of socket contacts 20 are axially positioned in insulators 22 and 24 mounted in the barrel 16. Each such contact 20 receives a pin contact 26 which is mounted in an insulator 28 in the receptacle connector member 14. A coupling nut 32 is retained on the barrel 16 of the plug connector member by a retaining ring 34. The forward end of the coupling nut is threadedly engaged with the shell 18 of the receptacle connector member 14.

The combined electrical shielding and environmental sealing element of the present invention, generally designated 36, is mounted in an annular groove 38 formed in the outer cylindrical surface 40 of the barrel 16. Alternatively, the groove could be formed in the inner surface of the receptacle shell 18. The bottom 42 of the groove provides a cylindrical surface which faces the inner cylindrical surface 44 of the receptacle shell 18.

Figure 6:
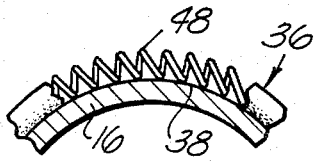
FIG. 6 is a transverse sectional view similar to FIG. 5 but showing only the plug barrel in which the electrical shielding and sealing element is mounted, wherein the element is shown in its unstressed condition.
Figure 5:
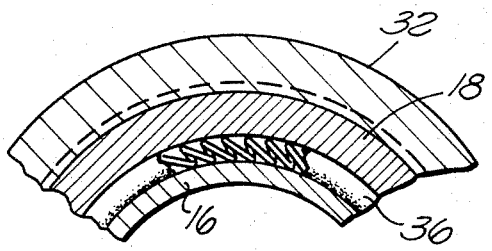
FIG. 5 is a fragmentary, transverse sectional view taken along line 5—5 of FIG. 1, showing the shielding and sealing element in its radially flattened condition, with a portion of the elastomer removed to show the shape of the coil spring embedded therein.
Figure 4:
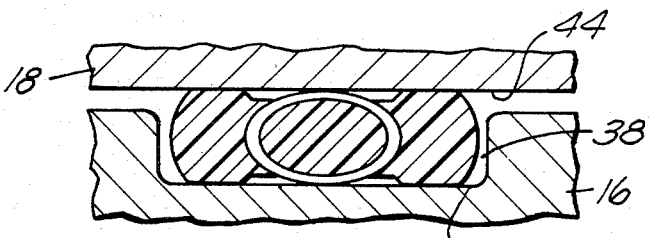
FIG. 4 is an enlarged cross sectional view of the area delineated by 4—4 of FIG. 1.
Figure 7:
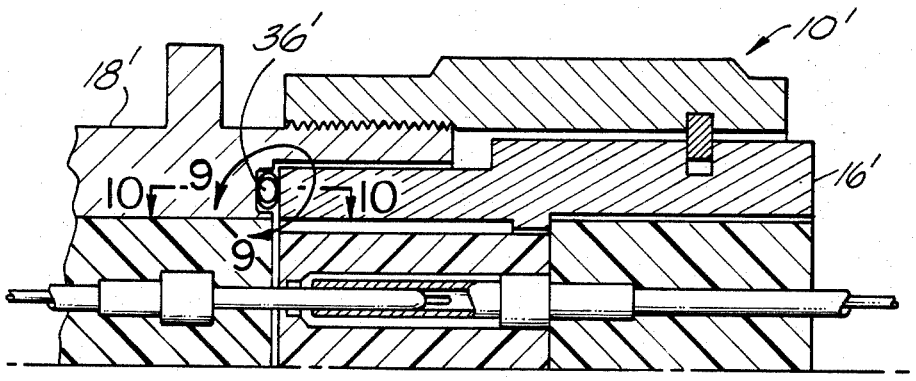
FIG. 7 is a partial longitudinal sectional view similar to FIG. 1 showing an electrical connector embodying an alternative form of the composite shielding and sealing element of the present invention using a different form of slant coil spring.
Figure 8:
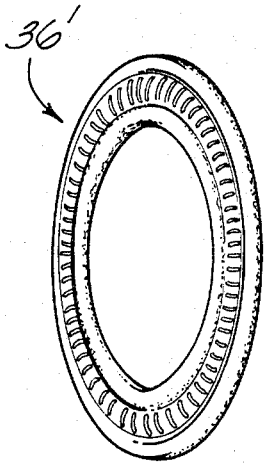
FIG. 8 is a perspective view of the shielding and sealing element illustrated in FIG. 7.
Figure 9:
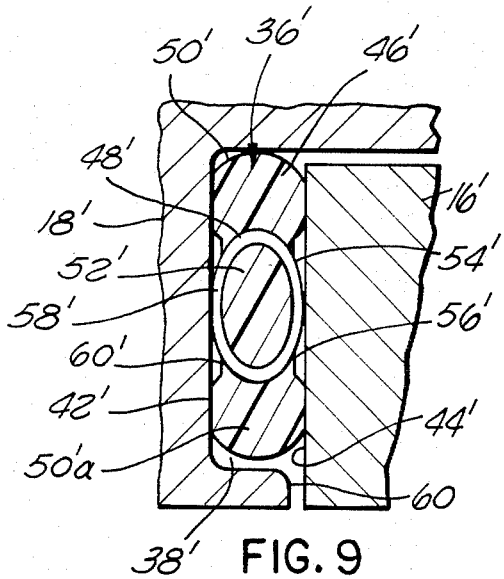
FIG. 9 is an enlarged sectional view of the area delineated by 9—9 of FIG. 7.

The combined electrical and environmental sealing element 36 is a closed loop composite preferably comprising a continous elastomeric ring 46 in which a slant helical coil spring 48 is partially embedded. In this embodiment of the invention, the coil spring is similar to that disclosed in the aforementioned U.S. Pat. No. 4,033,654. Each convolution of the helical coil spring lies in a slanted plane which is generally parallel to the center axis x—x of the connector and inclined with respect to the axis of the helix as seen in FIGS. 5 and 6. Expressed in other words, the plane of each convolution of the spring is disposed at an angle from a tangent to the outer circumference of the circular spring.

The elastomeric ring 46 preferably comprises a generally cylindrical ring having enlarged toroidal sealing portions 50 along its edges integral with a relatively narrow intermediate cylindrical web portion 52. The major portion of the spring 48 is embedded within the web portion of the elastomeric ring. The outer portion 54 of each convolution protrudes outside the outer surface 56 of the web portion of the elastomeric ring while the inner portion 58 of each convolution protrudes outwardly through the cylindrical inner surface 60 of the web portion of the ring so that the convolutions are exposed at both the inner and outer surfaces of the ring. The radial thickness of the enlarged annular sealing portions 50 of the elastomeric ring and the dimensions of the convolutions of the coil spring in the radial direction are greater than the depth of the groove 38 and greater than the distance between the cylindrical surfaces 42 and 44 in which the element 36 is mounted so that both the sealing portions of the ring and the coil spring will be compressed in the radial direction as the plug barrel 16 is pushed into the interior of the mating receptacle shell 18 when the plug and receptacle connector members are being interengaged. Before mating of the connector halves, the coil spring 48 takes the form illustrated in FIG. 6. When mating occurs, the convolutions of the coil spring increase their slant to provide an almost continuous metal shield between the mating halves. In addition, because of the slant design of the spring convolutions, a wiping action between the spring and the facing surfaces on the connector halves takes place which assures positive electrical continuity and thus an effective electrical joining (grounding) of the respective connector halves.

The elastomer of the ring 46 is preferably relatively soft, having a durometer of about 40, so that the slant helical coil spring 48 constitutes the principal spring member of the composite element 36, while the sealing portions 50 of the elastomer perform basically only a sealing function, rather than a spring function. By providing the toroidal portions 50 on both axial sides of the coil spring, it will be appreciated that such portions not only provide two sets of sealing ribs between the mating halves of the connector, but also provide seals on both sides of the coil spring to prevent dirt or other particles from reaching the interface between the exposed convolutions of the coil springs and the cylindrical surfaces 42 and 44 engaged thereby.

Reference is now made in FIGS. 7–11 of the drawings which illustrate the second embodiment of the invention, wherein parts similar to those employed in the embodiment illustrated in FIGS. 1–6 bear the same reference numerals primed. In this embodiment of the invention, the composite electrical shielding and environmental sealing elment 36' is mounted in an annular groove 38' formed in forwardly facing surface 60 of the receptacle shell 18. The bottom 42' of the groove provides an annular surface which faces the front annular surface 44' on the plug barrel 16' of the electrical connector 10'. Thus, in this embodiment of the invention the element 36' provides a compression seal, rather than a sliding seal as in the first embodiment of the invention.

Figure 11:
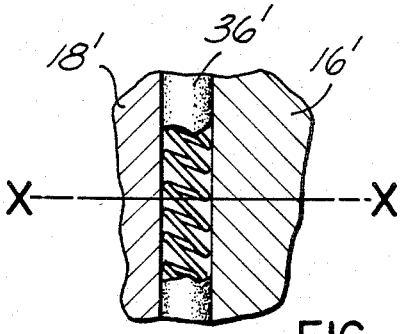
FIG. 11 is a sectional view similar to FIG. 10 showing the shielding and sealing element in its unstressed condition.
Figure 10:
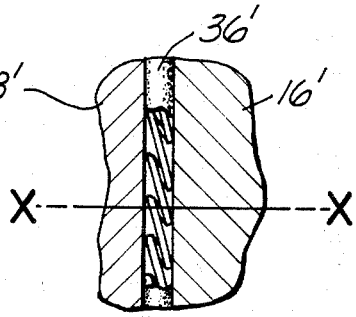
FIG. 10 is a transverse sectional view taken generally along line 10—10 of FIG. 7 showing a side view of the shielding and sealing element in its flattened condition, with a portion of the elastomer being removed to show the shape of the coil spring embedded therein.

The composite element 36' comprises an annular elastomeric ring 46' having an outer enlarged toroidal sealing portion 50' which surrounds an inner enlarged toroidal sealing portion 50*a*. The sealing portions are integral with a radially extending intermediate annular web portion 52'. A slant coil spring 48' is partially embedded in the web portion 52' of the elastomeric ring. The spring may be similar to that disclosed in the aforementioned U.S. Pat. No. 3,835,443. Each convolution of the spring lies in a slanted plane that intersects the center axis x—x of the connector members at an oblique angle, as seen in FIGS. 10 and 11. The forward portions 54' of the convolutions of the coil spring protrude forwardly beyond the front surface 56' of the web portion of the elastomeric ring, while the rear portions 58' protrude rearwardly beyond the rear surface 60' of the web portion of the ring. The thickness of the coil spring and the elastomeric ring in the axial direction of the connector is greater than the depth of the groove 38' so that when the mating halves are interengaged, the enlarged sealing portions 50' and 50'*a* of the ring will be axially compressed and the convolutions of the coil spring will be axially flattened as illustrated in FIG. 10. FIG. 11 shows the configuration of the coil spring before it is flattened. Therefore, it will be appreciated that the composite element 36' functions in a manner similar to the element 36 in the first embodiment of the invention except that the element is axially compressed upon mating of the connector halves, rather than radially squeezed in a sliding seal arrangement as in the first embodiment.

The composite RFI/EMI shielding and elastomeric sealing element of the present invention described so far may be manufactured by providing a coil spring of the desired length to fit into a groove in the connector shell, butt welding the ends of the spring so that it will be a continuous, integral element, molding the elastomeric ring around and through the spring in a suitable mold so that the opposite sides fo the spring, either radial or axial, will be exposed whereupon there is provided a one-piece element which may be easily mounted in a single groove in a connector shell. By this arrangement sealing continuity is provided around the periphery of the element since no butt joints are required to be made in the elastomer.

While it is preferred that the elastomeric ring and coil spring embedded therein of the composite electrical shielding and environmental sealing element of the present invention are both in the form of continuous loops, it will be appreciated that the ends of the coil spring need not necessarily be joined so long as they are very close to each other. Furthermore, in the compression seal arrangement illustrated in FIGS. 7 to 11, the composite element 36' need not be continuous. For example, the element could be formed of an elongated strip which is rolled into circular form with the ends of the strip beveled and overlapping. Such an overlapping joint would not be suitable for the sliding seal arrangement illustrated in FIGS. 1 to 6.

Figure 12:
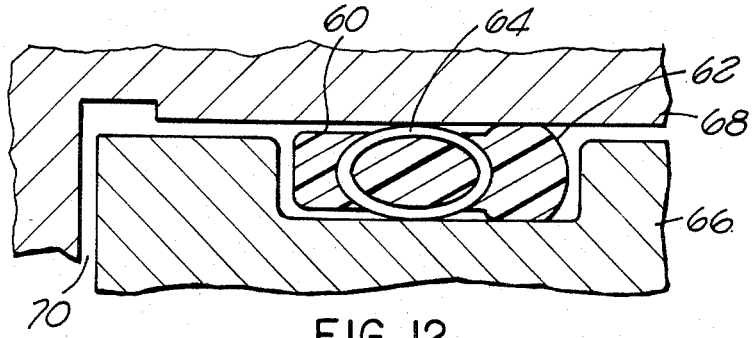
FIG. 12 is a cross-sectional view similar to FIG. 4 showing another form of the shielding and sealing element of the invention embodying only a single enlarged sealing portion.

In FIG. 12 there is shown a composite electrical shielding and environmental sealing arrangement to that illustrated in FIGS. 1 to 6 except that the composite shielding and sealing element 60 has only a single enlarged toroidal sealing portion 62. The sealing portion 62 is on the side of the coil spring 64 which is open to the space between the plug barrel 66 and coupling nut 68 so that the seal will be effective for preventing dust and other particles from reaching the interface 70 between the mating halves of the connector. If only a single enlarged sealing portion were to be utilized in the embodiment of the invention illustrated in FIGS. 7 to 11, the outer sealing portion 50' would be retained and the inner sealing portion 50'*a* eliminated.

In the embodiments illustrated in FIGS. 1 to 6 and in FIG. 12, it is preferred that the composite electrical shielding and environmental sealing element have a slight interference fit with the bottom of the groove in which it is mounted so that a seal is maintained between the element and the plug barrel even when the plug and receptacle members are disconnected from each other. If the shielding and sealing element were mounted in an internal groove in the receptacle shell, a like interference fit would be desired.

Figure 13:
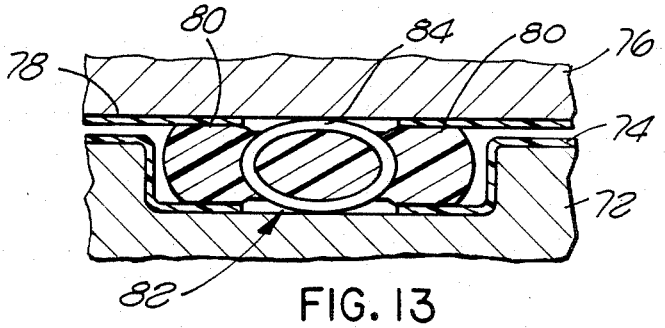
FIG. 13 is a cross-sectional view similar to FIG. 4; showing non-conductive layers on the outer surface of the plug barrel and inner surface of the receptacle shell.

The embodiment of the invention illustrated in FIG. 13 is similar to that illustrated in FIGS. 1 to 6 except that the outer surface of the plug barrel 72 is provided with a non-conductive layer 74 while the inner surface of the receptacle shell 76 is provided with a similar non-conductive layer 78. The layers may be an anodized coating, a plastic coating or the like. The layers 74 and 78 are interrupted between the enlarged sealing portions 80 of the composite shielding and sealing element 82 so that the coil spring 84 of the element will contact the bare cylindrical surfaces of the barrel 72 and shell 76. The non-conductive layers may be desired for corrosion resistance.

Figure 14:
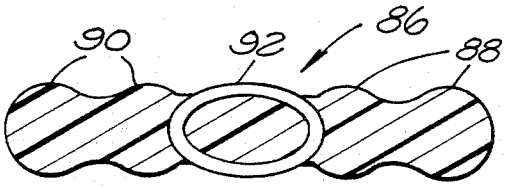
FIG. 14 is a transverse sectional view similar to FIG. 3 showing another embodiment of the shielding and sealing element of the invention having two enlarged sealing portions on opposite sides of the coil spring.

FIG. 14 shows an alternative form of the combined electrical shielding and environmental sealing element of the present invention, generally designated 86, which is similar to the element 36 illustrated in FIGS. 1 to 6 except that there are provided a pair of enlarged sealing portions 88 and 90 on opposite sides of the coil spring 92 thus providing a set of four sealing ribs on the inner and outer surface of the element 86, and a pair of oppositely facing sealing ribs on opposite sides of the spring. The composite element 36' illustrated in FIGS. 7 to 11 could likewise be provided with a multiple sealing arrangement similar to that illustrated in FIG. 14.

Figure 16:
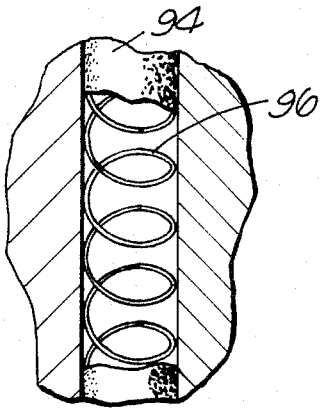
FIG. 16 is a fragmentary sectional view similar to FIG. 11 showing the shielding and sealing element of FIG. 15 in an uncompressed condition.
Figure 15:
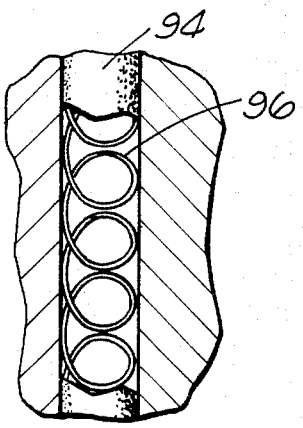
FIG. 15 is a fragmentary sectional view similar to FIG. 10 showing a shielding and sealing element embodying a standard helical coil spring, the spring being shown as being axially compressed.

The invention is not limited to the use of a slant coil spring as the electrical shielding spring in the composite shielding and environmental sealing element. As shown in FIGS. 15 and 16, the shielding and sealing element 94, mounted in a connector assembly similar to that illustrated in FIGS. 7 to 11, may be a standard helical coil spring 96 having elliptical convolutions which are compressed axially when the mating halves of the connector are interengaged, rather than flattened by increasing their slant as in the first two embodiments of the invention disclosed herein.

While the composite shielding and sealing element of the present invention has been specifically described and illustrated herein as being in a circular form, it will be appreciated that the element could assume other shapes depending upon the configuration of the connector. For example, the element could be mounted in a "rectangular" connector in which case the element would assume the configuration of the D-shaped shell of the connector. Thus, the term "ring" as used in the claims appended hereto is intended to embrace loop structures of any configuration, including circular, rectangular, D-shaped, etc.

While the spring in the environmental sealing element of the present invention has been characterized herein as providing EMI/RFI shielding, it will be appreciated that the extent of the shielding will be dependent upon the wave length of the interfering signals and the size of the gaps existing between the convolutions of the spring. In some applications of the invention the spring may function simply as a grounding connection, rather than as an effective shield. Accordingly, it is intended that the present invention embrace seals containing springs which may function as either effective shields and ground connections, or only as grounding connections. The term "electrical connecting" recited in the appended claims is intended to cover either or both functions.

What is claimed is:

1. An electrical connector comprising:

first and second mating connector members having spaced peripheral surfaces thereon facing each other when said connector members are mated defining a space therebetween, said peripheral surfaces being substantially perpendicular to the center axis of said connector members;

a substantially closed loop combined electrical connecting and environmental sealing element disposed in said space;

said element comprising an elastomeric ring having a slant helical coil spring partially embedded therein, each convolution of said helical coil spring lying in a slanted plane that intersects said center axis at an oblique angle, the convolutions of said coil spring being exposed at the edgs of said ring on opposite sides thereof and adjacent to said peripheral surfaces of said connector members;

said elastomeric ring embodying a pair of enlarged sealing portions one surrounding the other and joined by a radially extending relatively narrow web portion, the major portion of said coil spring being embedded in said web portion between said sealing portions, and sealing portions providing oppositely facing sealing ribs each adjacent to a respective one of said peripheral surfaces; and the outside dimensions of said convolutions and of said enlarged sealing portion of said ring in the direction between said peripheral surfaces being greater than the distance between said surfaces whereby said convolutions will deform and said sealing ribs will be axially compressed between said peripheral surfaces when said connector members are mated causing said spring to be axially flattened.

2. An electrical connector member adapted to mate with a second connector member comprising:

a connector shell having a continuous groove in a forwardly facing surface thereof coaxial with the center axis of said shell;

a substantially closed loop combined electrical connecting and environmental sealing element positioned in said groove;

said element comprising an elastomeric ring and a slant helical coil spring partially embedded therein;

each convolution of said helical coil spring lying in a slant plane that intersects said center axis at an oblique angle;

the convolutions of said coil spring being exposed at the front and rear surfaces of said elastomeric ring;

said elastomeric ring embodying a pair of enlarged sealing portions one surrounding the other and joined by a relatively narrow radially extending web portion, the major portion of said coil spring being embedded in said web portion between said sealing portions; and the dimensions of the convolutions of said coil spring and of said enlarged sealing portions of said ring in the axial direction being greater than the depth of said groove.

3. An electrical connector member adapted to mate with a second connector member comprising:

a connector shell having inner and outer surfaces coaxial with the center axis of said shell;

a continuous groove formed in one of said surfaces;

a substantially closed loop combined electrical connecting and environmental sealing element positioned in said groove;

said element comprising an elastomeric ring and a slant coil spring loop partially embedded therein;

each convolution of said helical coil spring lying in a slanted plane which is generally parallel to the center axis of said shell and inclined with respect to the axis of the helix;

the convolutions of said coil spring being exposed at the inner and outer surfaces of said elastomeric ring;

said elastomeric ring embodying a pair of enlarged sealing portions spaced axially from each other and joined by a relatively narrow cylindrical web portion, the major portion of said coil spring being embedded in said web portion between said sealing portions; and the dimensions of the convolutions of said coil spring and of said enlarged sealing portions of said ring in the radial direction being greater than the depth of said groove.

4. An electrical connector comprising:

first and second mating connector members having spaced peripheral surfaces thereon facing each other when said connector members are mated defining a space therebetween, said peripheral surfaces surrounding the center axis of said connector members;

a substantially closed loop combined electrical connecting and environmental sealing element disposed in said space;

said element comprising an elastomeric ring having a slant helical coil spring partially embedded therein, each convolution of said helical coil spring lying in a slanted plane which is generally parallel to said center axis and inclined with respect to the axis of the helix;

the convolutions of said coil spring being exposed at the edges of said ring on opposite sides thereof and adjacent to said peripheral surfaces of said connector members;

said elastomeric ring embodying a pair of enlarged sealing portions spaced axially from each other and joined by a relatively narrow web portion, the major portion of said coil spring being embedded in said web portion between said sealing portions, said sealing portions providing oppositely facing sealing ribs each adjacent to a respective one of said peripheral surfaces; and the outside dimensions of said convolutions and of said enlarged sealing portion of said ring in the direction between said peripheral surfaces being greater than the distance between said surfaces whereby said convolutions will deform and said sealing ribs will be radially compressed between said peripheral surfaces when said connector members are mated causing said convolutions to be displaced in a circumferential direction into a greater slant relation.

5. An electrical connector comprising:

first and second mating connector members having spaced peripheral surfaces thereon facing each other when said connector members are mated defining a space therebetween; p1 a substantially closed loop combined electrical connecting and environmental sealing element disposed in said space;

said element comprising an elastomeric ring having a helical coil spring partially embedded therein;

the convolutions of said coil spring being exposed at the edges of said ring on opposite sides thereof and adjacent to said peripheral surfaces of said connector members;

said elastomeric ring embodying an enlarged sealing portion on at least one side of said coil spring providing oppositely facing sealing ribs each adjacent to a respective one of said peripheral surfaces;

the outside dimensions of said convolutions and of said enlarged sealing portion of said ring in the direction between said peripheral surfaces being greater than the distance between said surfaces whereby said convolutions will deform and said sealing ribs will be compressed when said connector members are mated; and a non-conductive layer on the outer surface at least one of said connector members, said layer being interrupted to leave exposed the peripheral surface of said connector member at the area of contact with the exposed convolutions of said coil spring.

6. A receptacle connector member adapted to mate with a plug connector member comprising:

a connector shell having a forwardly extending cylindrical portion having a leading edge, a forwardly facing annular surface inside said shell spaced behind said edge;

a substantially closed loop combined electrical connecting said environmental sealing element positioned inside said cylindrical portion against said annular surface;

said element comprising an elastomeric ring having a helical coil spring partially embedded therein;

the convolutions of said spring being exposed at the front and rear surfaces of said ring; and said elastomeric ring embodying an enlarged sealing portion on the outer side of said coil spring providing oppositely facing sealing ribs, one of said ribs engaging said annular surface, said spring and said ribs being adapted to be deformed axially when a plug connector member is inserted into said shell.

7. A receptacle connector member as set forth in claim 6 wherein:

a forwardly facing shoulder is formed inside said shell spaced behind said leading edge;

an annular groove is provided in said shoulder, the bottom of said groove providing said annular surface; and said element is mounted in said groove.

8. An electrical connector member comprising:

mating plug and receptacle connector members;

said plug connector member having a barrel slidable within the shell of the receptacle connector member;

said shell and said barrel having inner and outer cylindrical surfaces, respectively, facing each other when the connector members are mated;

an annular groove in one of said surfaces defined by forwardly and rearwardly facing shoulders;

a substantially closed loop combined electrical connecting and environmental sealing element mounted in said groove;

said element comprising an elastomeric ring having a helical coil partially embedded therein;

the convolutions of said spring being exposed at the inner and outer surfaces of said ring; and said elastomeric ring embodying an enlarged sealing portion adjacent to said forwardly facing shoulder providing inner and outer sealing ribs, said spring and said ribs being deformed radially when said barrel slides into said shell, said element providing a sliding seal between said plug and receptacle connector members.

* * * * *